United States Patent [19]

Proctor

[11] Patent Number: 4,738,008

[45] Date of Patent: Apr. 19, 1988

[54] APPARATUS FOR FORMING A NON-ROTATING METAL STRIP HELIX

[75] Inventor: John S. Proctor, St. Albans, Great Britain

[73] Assignee: T. I. Flexible Tubes Limited, Enfield, England

[21] Appl. No.: 854,150

[22] Filed: Apr. 21, 1986

[30] Foreign Application Priority Data

Apr. 20, 1985 [GB] United Kingdom ..... 8510158

[51] Int. Cl.[4] ..... B21C 37/00

[52] U.S. Cl. ..... 29/33 D; 72/49

[58] Field of Search ..... 29/33 D, 335; 72/49, 72/50

[56] References Cited

U.S. PATENT DOCUMENTS 1,004,643 10/1911 Gilson ..... 72/49 X
1,105,836 8/1914 Ramsey et al. ..... 72/49 X
1,668,758 5/1928 Bryant ..... 72/49 X

FOREIGN PATENT DOCUMENTS 315478 2/1934 Italy ..... 29/33 D
474796 12/1953 Italy ..... 72/49

*Primary Examiner*—Z. R. Bilinsky
*Attorney, Agent, or Firm*—Gifford, Groh, VanOphem, Sheridan, Sprinkle and Dolgorukov

[57] ABSTRACT

Apparatus for forming a non-rotating helix of metal strip. The apparatus includes a store for the strip rotatable about the axis of the helix. The store has a radially inwardly facing circumferential opening from which the strip is withdrawn by guide shoes which are also rotatable about the axis of the helix but at a different rotational speed to that of the store so that the difference in diameter of the strip on leaving the store and entering the helix is accommodated. The guide shoes deliver the strip to guide rollers rotating with the guide shoes by which the strip is guided in a spiral to non-rotating helix-forming shoes from which the coils of the helix are delivered in an axial direction.

5 Claims, 2 Drawing Sheets

APPARATUS FOR FORMING A NON-ROTATING METAL STRIP HELIX

The invention relates to apparatus for forming a non-rotating metal strip helix and is particularly, but not exclusively, applicable to apparatus for the formation of a helix from a metal strip which has previously been roll-formed into a complex cross-section.

According to the invention, apparatus for forming a non-rotating metal strip helix, includes a store for the strip, the store being rotatable about the axis of the helix; feeding apparatus for withdrawing the strip from the store, the feeding apparatus being rotatable about the axis of the helix at a different rotational speed from the store, and helix-forming means rotatable with the feeding apparatus.

The store may be a drum having a radially inwardly facing circumferential opening.

The apparatus may include a non-rotary mandrel around which the helix-forming means wraps the strip. Alternatively, the apparatus may include a plurality of co-acting rollers positioned to bend the strip, fed by the feeding apparatus, into the helix.

Conveniently, the feeding apparatus includes pairs of forming rollers to form the strip into a section suitable for interengagement of adjacent coils of the helix.

Furthermore, the apparatus may include means rotatable with the feeding apparatus to interengage the adjacent coils of the helix and to introduce means to inhibit disengagement of the adjacent coils.

Apparatus in accordance with the invention is described, by way of example only, with reference to the accompanying drawings, in which.

Figures 1, 2:
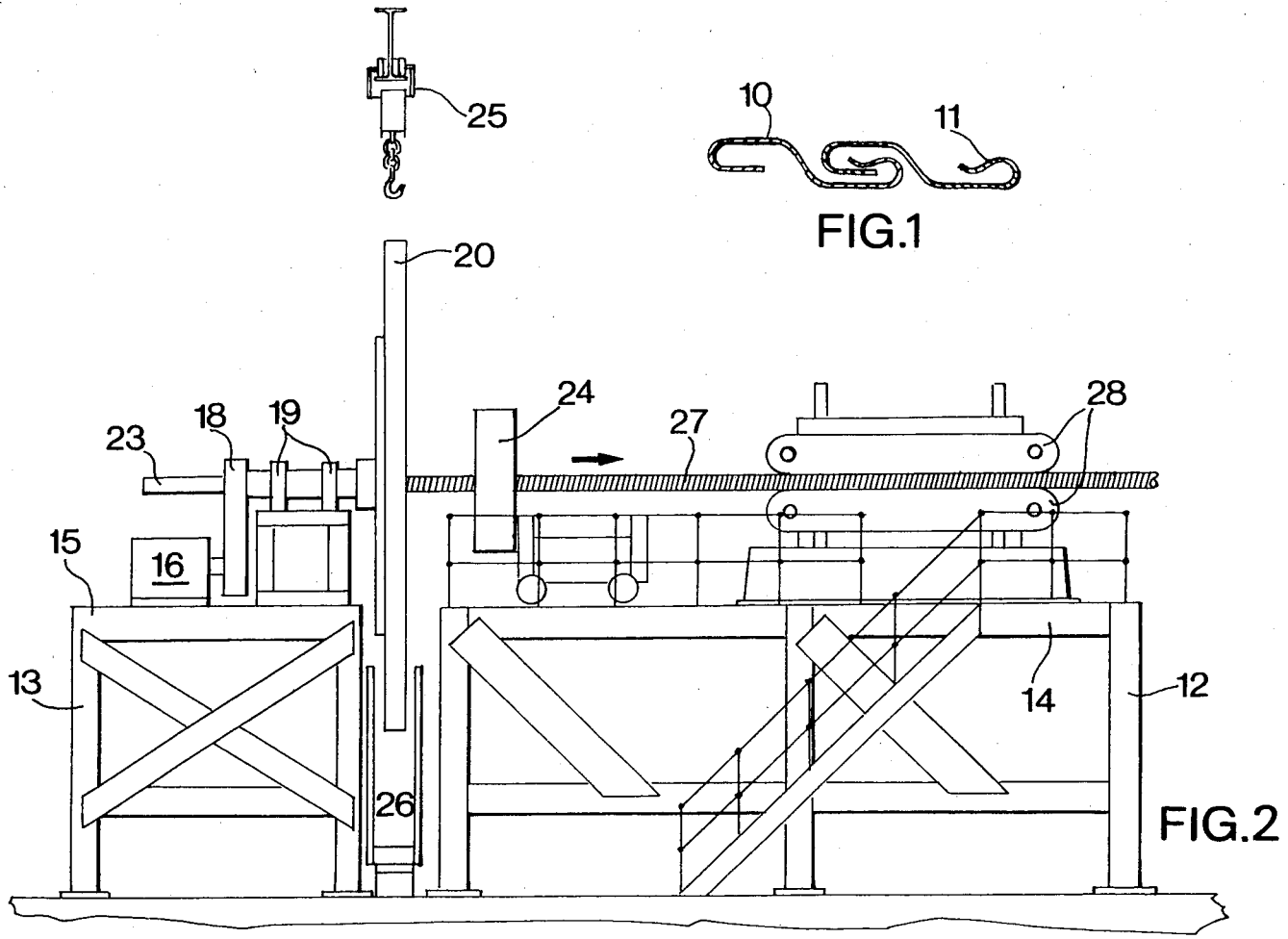
FIG. 1 is a cross-section, to enlarged scale, of two interengaged coils of metal strip.
FIG. 2 is an elevation to reduced scale, of a machine for winding such coils from metal strip.

FIG. 1 shows, in cross-section, two adjacent coils 10, 11 of a helically-wound flexible metal tube of known kind. The coils 10,11 are of generally S-section shape with part of the S of one coil interengaged with a different part of the S of the adjacent coil, in such a manner that a flexible connection between the coils 10, 11 is made without the possibility of subsequent unintentional disengagement.

In FIG. 2, frames 12, 13 support aligned platforms 14, 15 respectively. An electric motor 16 drives a rotary head 17, to be described more fully with reference to FIGS. 3 and 4, through a belt drive 18. The rotary head 17 is mounted on bearings 19.

Figure 4:
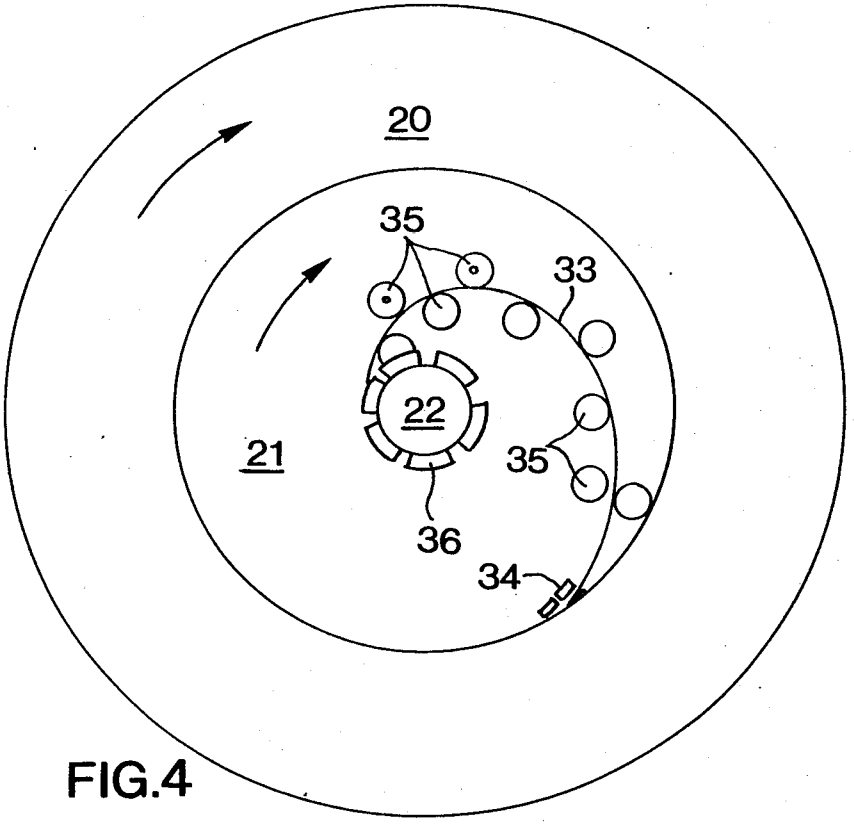
FIG. 4 is an end view of FIG. 3.
Figure 3:
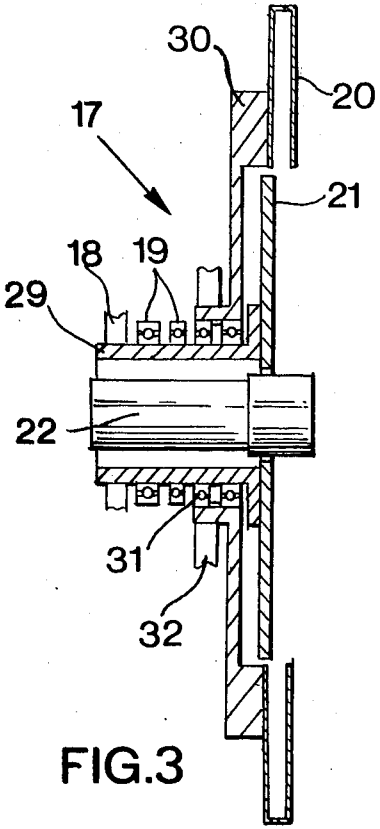
FIG. 3 is an axial cross-section of part of the machine shown in FIG. 2.

The rotary head 17 carries a storage drum 20 and a face plate 21 (unseen in FIG. 2 but shown in FIGS. 3 and 4). A mandrel 22 (in FIG. 3) is withdrawable axially out of the plane of the drum 20 by means of a hydraulic ram 23. The face plate 21, and associated components, can also be removed from the plane of the drum 20 by disengaging the face plate 21 from the rotary head 17, engaging it with part of a trolley 24, running on the platform 14, and moving the trolley 24 and face plate 21 away from the drum 20. A crane 25 can engage the drum 20 and lower it on to a carriage 26, whereby the drum 20 can be removed from the machine for refilling with the metal strip.

In operation, a helix 27 made from metal strip, issues from the rotary head 17 and is drawn away therefrom by powered belts 28. This possibility arises since the helix 27 is travelling linearly but is not rotating.

In FIGS. 3 and 4 the face plate 21 is mounted on a sleeve 29, carried by the bearings 19 and driven by the belt drive 18. The drum 20 is of generally U-section, open towards the axis of rotation. The drum 20 is removably fastened to a carrier 30, mounted on the sleeve 29 through bearings 31 and driven from the electric motor 16 through an unshown variable speed drive and a belt drive 32.

The drum 20 is filled, away from the machine, with metal strip, typically of the cross-sectional shape shown in FIG. 1 by filling from the outer diameter towards the inward opening of the drum 20. The filled drum 20 is returned to the machine, mounted on the carrier 30, the mandrel 22 is moved into the position shown and the face plate 21 is remounted on the sleeve 29.

As shown in FIG. 4, the strip 33 feeds from within the drum 20 through guide shoes 34 and a succession of guide rollers 35, all mounted on the face plate 21, and arranged to define a spiral path towards the mandrel 22.

The mandrel 22 does not rotate, so that as the face plate 21 is rotated in the direction of the arrow, the strip 33 is engaged by forming shoes or forming rollers 36, mounted on the face plate 21 and rotating therewith, to deform the strip 33 into a helix on the mandrel 22, from which it passes axially towards the belts 28.

The supply of the strip 33 is taken from the drum 20 at the necessary linear speed with which the strip 33 is laid on the mandrel 22. Since the drum 20 and mandrel 22 are of substantially different diameters, and since the radius from which the strip 33 is drawn from within the drum 20, increases as the stock within the drum is depleted, it is necessary to vary the speed of rotation of the drum 20 relative to the face plate 21.

The apparatus has so far been described as storing previously rollformed metal strip and turning it into a non-rotating helix 27 of which adjacent coils 10, 11 are not engaged at that point, and which are fed by the belts 28 to another machine (not shown) for subsequent permanent interengagement of the adjacent coils 10, 11 to form flexible metal tube. However, by appropriate choice of the section of the strip 33 supplied from the drum 20, the forming shoes or rollers 36 can be arranged to perform the interengagement operation and the introduction of an appropriate feature, such as a deformation of the strip 33 or a locking wire, to prevent the coils 10, 11 becoming subsequently disengaged, so that the flexible metal tube will then be formed direct on the mandrel 22. Since the metal tube is not rotating it can be passed to storage, for example on to a drum.

In a further embodiment of the apparatus according to the invention, the rollers 35 can be mounted in pairs and have an appropriate profile, to act as the form rollers of the metal strip 33. In this manner, the strip within the drum 20 will be of flat section, so that a much greater quantity can be stored within the drum 20 than is possible for the section shown in FIG. 1, and is then formed into a non-interengaged helix 27 or into the flexible metal tube formed by interengaging adjacent coils of the helix.

For some requirements, the mandrel 22 may be omitted and the strip 33 formed into an open coil helix, in which the adjacent coils are not interengaged, by feeding the strip 33 through the pinches between an internal roll and two external rolls, adjacent each other and spaced circumferentially about the internal roll, these internal and external rolls being rotatable on spindles mounted on the face plate 21 and parallel to the axis of rotation thereof.

What we claim as our invention and desire to secure by Letters Patent of the Unites States is:-

1. Apparatus for forming a non-rotating helix from a coil of metal strip, the apparatus comprising an annular storage drum for receiving said coil, said drum having a radially-inwardly facing circumferential opening at its radially inner circumference through which a continuous length of said strip is withdrawn to a region radially within said radially-inner circumference of the drum; mounting means for said drum co-axial with the axis of the helix, said drum being freely rotatable on said mounting means about said axis as the strip is being withdrawn therefrom; a carrier rotatable about said axis independently of said drum within said region; shaft means for drivingly rotating said carrier about said axis; feeding means mounted on said carrier for bodily rotation therewith and engageable with said continuous length of strip to guide and feed said length of strip toward said axis and helix-forming means also mounted on said carrier for bodily rotation therewith adjacent said axis and receiving said continuous length of strip from said feeding means, rotation of said carrier effecting continuous withdrawal of said strip from the drum and formation of said non-rotating helix, the drum rotating independently of said carrier at a speed depending upon the linear speed of the strip as it is being withdrawn and the radius at any instant of the innermost convolution of the coil from which the strip is being withdrawn.

2. Apparatus, according to claim 1 including a non-rotary mandrel positioned co-axially of the drum and said carrier and around which the helix-forming means wraps the strip.

3. Apparatus, according to claim 1 in which the feeding means includes a plurality of spaced pairs of coacting rollers positioned to guide the strip toward the helix-forming means.

4. Apparatus, according to claim 1 in which the feeding apparatus includes spaced pairs of forming rollers to form the strip into a section suitable for interengagement of adjacent coils of the helix.

5. Apparatus, according to claim 1 including means rotatable with the feeding apparatus to interengage the adjacent coils of the helix and to introduce means to inhibit disengagement of the adjacent coils.

* * * * *